United States Patent [19]

Gourley

[11] 3,963,302

[45] June 15, 1976

[54] ELECTRICAL CRIMP REMOVABLE SOCKET CONTACT

[75] Inventor: Charles A. Gourley, Bethel, Conn.

[73] Assignee: Litton Systems, Inc., Beverly Hills, Calif.

[22] Filed: Mar. 18, 1974

[21] Appl. No.: 451,738

[52] U.S. Cl. ..... 339/217 S; 339/258 R; 339/276 T

[51] Int. Cl.[2] ..... H01R 11/22; H01R 13/42

[58] Field of Search ..... 339/217 S, 256 R, 256 SP, 339/258 R, 258 S, 276 R, 276 T, 275 R, 275 T

[56] References Cited

UNITED STATES PATENTS

| | | | |
|---|---|---|---|
| 2,794,964 | 6/1957 | Hoffman | 339/276 T |
| 3,363,224 | 1/1968 | Gluntz | 339/276 T |
| 3,550,067 | 12/1970 | Hansen | 339/256 SP |
| 3,601,783 | 8/1971 | Loose | 339/275 T |
| 3,781,723 | 12/1973 | Harwood | 339/128 |

FOREIGN PATENTS OR APPLICATIONS

| | | | |
|---|---|---|---|
| 1,113,856 | 5/1968 | United Kingdom | 339/258 S |

OTHER PUBLICATIONS

Economical Connections on the Z3 Level, Powell Electronics, Inc., Philadelphia, Pa., Received 10–2–73.

*Primary Examiner*—Roy Lake
*Assistant Examiner*—Neil Abrams
*Attorney, Agent, or Firm*—M. Michael Carpenter; Alan C. Rose; Alfred B. Levine

[57] ABSTRACT

An improved electrical crimp removable socket contact is shown, having a box-like section capable of mating with a square wrap post or round pin at one end and an open barrel section for crimping a wire and its insulation at the other end. The box-like section and open barrel section are joined by a central box section which includes a retention leaf spring and an internal stop for controlling the seating of the socket contact upon the square wrap post or round pin while, at the same time, providing a stop for the wire and strengthening the box sections when the contact is crimped onto the wire.

3 Claims, 5 Drawing Figures

ELECTRICAL CRIMP REMOVABLE SOCKET CONTACT

BACKGROUND OF THE INVENTION

The present invention relates to an electrical crimp removable contact and, more particularly, to a socket contact that may be crimped onto an insulated wire through the use of an open barrel section at one end; while the open barrel section is joined by a central box section to a box-like section at the other end which receives a square wrap post or round pin for providing electrical continuity therebetween.

The utilization of an open barrel section to join a contact to an insulated wire by crimping the open barrel closed upon the wire is known in the prior art. It is also known to provide a socket contact in which the socket is formed by a box-like section having spring tangs for wiping a post or a round pin received within the box section. The joining of the known end sections to form a socket contact that may be mounted in an insulated housing is also known.

The present invention discloses an arrangement wherein a socket contact is placed within an insulated housing to form a connector referred to herein as a "piggy back connector." This connector utilizes a relatively idle dimension on square wrap posts that extend, for example, from a back panel, a printed circuit board or a mounting frame on a $0.125 \times 0.125$ inch grid or a $0.100 \times 0.100$ inch grid. Conductive wires are attached to each post by automatic equipment which wraps each wire about each post to join various posts for completion of a desired electrical circuit. The back panel, printed circuit board or mounting frame forms a plane from which the square posts extend perpendicularly. Each post is joined to another post by a wire which is wrapped about the post just above the mounting plane at a level referred to herein as the $Z_1$ level. Should an electrical circuit be extended beyond the connection of two square posts, such extension is accomplished by wrapping a wire at the next higher level on the second square post and connecting that wire to a third square post at the $Z_1$ level or the next higher level, referred to herein as the $Z_2$ level.

As mentioned above, the piggy back connector in which the electrical crimp removable socket contact of the present invention is used effectively utilizes a relatively idle dimension on the square posts. This dimension is the next highest level above the $Z_2$ level of each post and is described herein as the $Z_3$ level. The $Z_3$ level is used to provide further circuit configurations, and the piggy back connector is provided to simplify such configurations.

In the piggy back connector, it is desirable to provide stops which positions the piggy back connector at the $Z_3$ level. It may also be desirable to provide an arrangement wherein the piggy back connector may be positioned at the $Z_1$ level, if no wires are wrapped about the posts, or even the $Z_2$ level. If possible, the stop arrangement for each level should provide a stop for the wire which is to be crimped within the open barrel section of the contact.

SUMMARY OF THE INVENTION

To achieve these desired features, a contact is provided for electrically connecting a wire crimped to an open barrel section of the contact to a square wrap post or round pin received by a box-like section at the other end of the contact. The open barrel section and box-like end section are joined by a central box section which includes a retention leaf spring for retaining the socket contact within its insulated housing. Also formed within the central box section is an internal stop which provides a stop for the square wrap post or round pin and, at the same time, provides a stop for the insulated wire as it is inserted into the open barrel section for crimping. The stop further strengthens the central box section and the box-like end section during the crimping operation.

Accordingly, an object of the present invention is to provide an improved removable electrical contact which provides electrical continuity between a square post or round pin and an insulated wire.

Another object of the present invention is to provide a crimp socket contact that removably mounts within an insulated housing to form a connector which mounts on a square post or round pin and provides an electrical connection between such post or pin and an insulated wire connected to the contact. The contact is provided with an internal stop for aligning the housing in which it mounts on the post or pin and for aligning the insulated wire within the contact before the wire is crimped to the contact.

Other objects and advantages of the present invention will become apparent to those skilled in the art after consideration of this specification in combination with the referenced drawings, wherein:

DESCRIPTION OF THE PREFERRED EMBODIMENT

Figure 1:
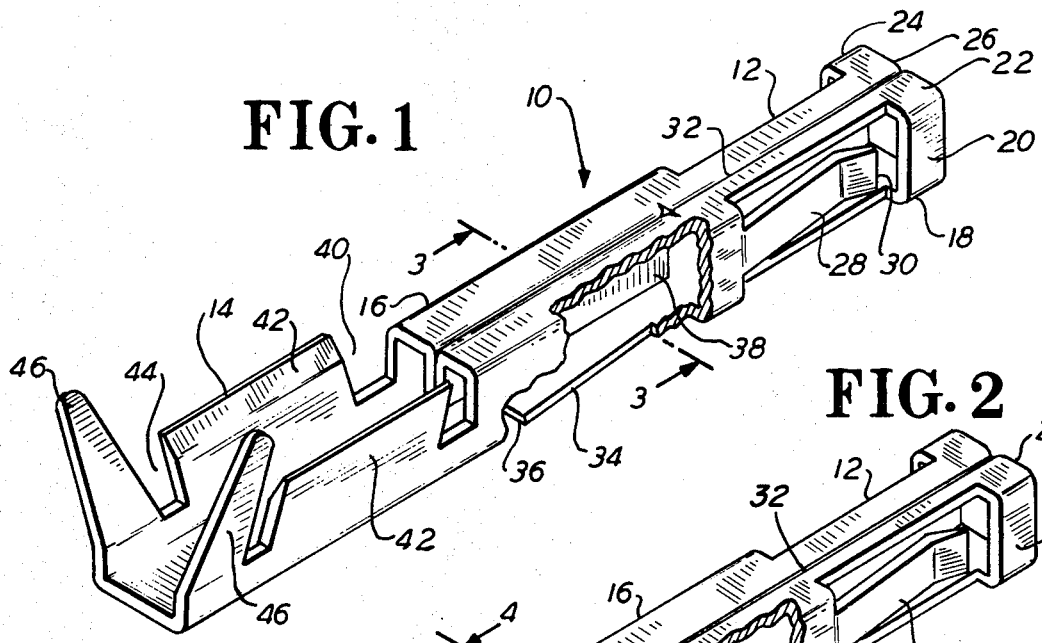
FIG. 1 is a perspective view of a crimp removable socket contact of the present invention, showing one embodiment of an internal stop.

Referring now to FIG. 1 of the drawings, the crimp removable socket contact of the present invention is shown generally at 10 having a box-like end section 12 and an open barrel section 14 joined by a central box section 16. The contact may be formed by stamping a thin metal sheet, such as beryllium copper, into the configuration illustrated. The box-like section 12 is formed with four side walls, including lower side 18, near side 20, upper side 22 and far side 24. The four side walls are first stamped from a flat piece of sheet metal which is then deformed into the box-like section 12 having an open end 26 sized to receive either a square wrap post or round pin, not shown. Cantilevered spring tangs 28 for wiping the post or pin are formed in near side wall 20 and far side wall 24 with a free end 30 nearest to open end 26 deformed into the box-like section 12 and the other end integral with the respective side wall. The upper side wall 22 is symmetrically formed by equally foreshortened portions which abut one another at the center of the side wall 22 to form a longitudinal slot 32 which parallels the longitudinal axis of the contact 10 formed by the four sides of the box-like section 12.

Figure 3:
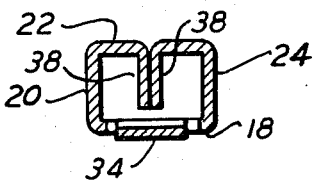
FIG. 3 is a cross-sectional view taken along lines 3—3 of FIG. 1.

Side walls 18, 20, 22 and 24 are extended to form the central box section 16 of contact 10, see FIG. 3. In the central box section, lower side 18 is relieved to form a retention leaf spring 34 having its free end 36 extending outwardly from the lower side 18 in a direction opposite from the open end 26 of the end box-like section 12. The upper surface 22 of the central box section 16 does not terminate at the slot 32 as in the adjacent box-like section. Instead, the upper surface 22 is extended and inwardly deformed into the center of the central box section to form stop walls 38. The two stop walls thus formed extend fully across the box-like central section 14 to abut or nearly abut the lower side wall 18 thereof. In this manner, the upper or righthand edge of the stop walls 38 traverse the lower portion of the box-like section 12 to form a stop therein which prevents further penetration of either a square wrap post or a round pin.

The stop 38 thereby retains the contact and the housing in which it mounts at the so-called $Z_3$ level. Obviously, the right-hand edge of the stop walls 38 may be moved to the left to provide a stop for the housing at the $Z_2$ level. The lower or left-hand edge of the stop walls 38 closes the upper portion of the open barrel section 14 for preventing the penetration of a wire beyond that point. As seen in FIG. 3, the presence of the stop walls 38 reinforces the central box section and prevents its closure during the crimping operation when the open barrel section 14 is attached to an insulated wire.

The open barrel section 14 is formed by the extension of the lower side wall 18, near side wall 20 and far side wall 24 of the central box section 16. In the U-shaped open barrel section, near side wall 20 and far side wall 24 are relieved at 40 to form wire crimping beams 42 in each wall. The near and far sides 20 and 24 are again relieved at 44 to form insulation crimping beams 46. The insulation crimping beams 46 and wire crimping beams 42 are shown in their uncrimped configuration prior to being crimped upon an insulated wire, not shown.

Figure 2:
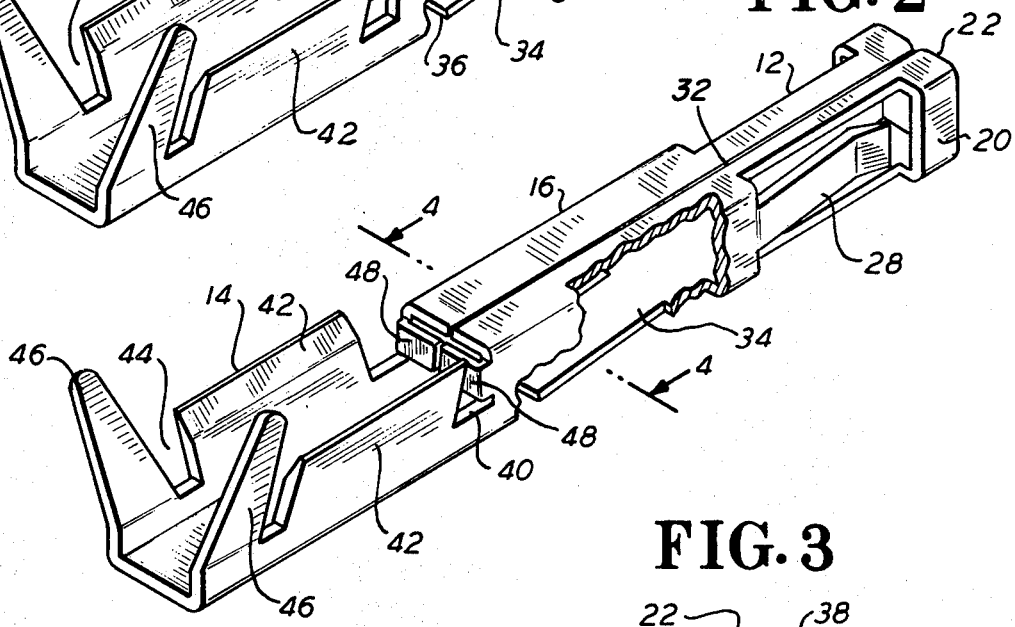
FIG. 2 is a perspective view of the crimp removable socket contact of the present invention, showing another embodiment of the internal stop.
Figure 4:
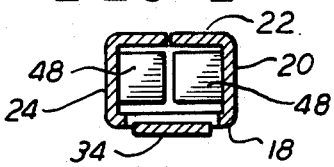
FIG. 4 is a cross-sectional view taken along lines 4—4 of FIG. 2.

Referring now to FIG. 2, the contact of the present invention is again shown as in FIG. 1 with a variation of the stop walls 38. The contact shown in FIG. 1 is arranged to provide stops which retain the contact and thus its connector at the $Z_3$ level. The contact in FIG. 2 illustrates stops which retain the contact and its connector at the $Z_1$ level. In the central box section 16 of the contact shown in FIG. 2, the longitudinal slot 32 which divides the upper wall 22 is not extended to form the stop walls 38 of FIG. 1. Rather, at the lower portion of the central box section 16, the near and far side walls 20 and 24 are each provided with an extending stop tab 48 which is integral with the left-hand edge of each side wall at a point where the side walls form the bottom of the central box section 16, see FIG. 4. Tabs 48 are deformed at right angles to the side walls 20 and 24 and provide a stop at the bottom of the central section 16 while providing a stop at the top of the open barrel section 12. The stop tabs 48 may be designed to abut each other after deformation or to abut the top and bottom side walls 18 and 22. This will strengthen the end box section 12 and central box section 16 when beams 42 and 46 are crimped upon an insulated wire. In the preferred embodiment, it may also be desirable to provide the relief 40 with a larger area from which to stamp the extending tabs 48.

Figure 5:
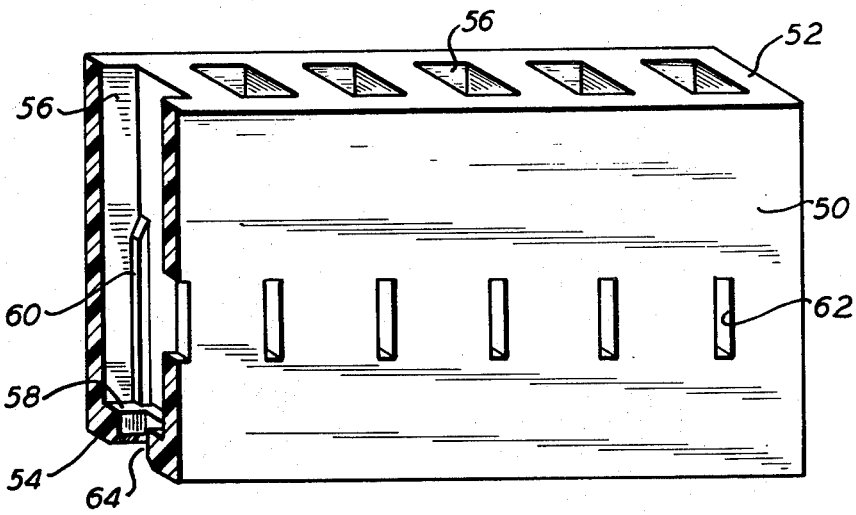
FIG. 5 is a perspective view of an insulated housing, shown partially broken away, which removably receives the crimp removable socket contact shown in FIGS. 1 and 2.

Referring now to FIG. 5, an insulated housing 50 is shown which is capable of receiving the contacts illustrated in FIGS. 1 and 2. The housing 50 has a generally rectangular cross section with upper and lower surfaces 52 and 54, respectively. Extending between the upper and lower surfaces are a plurality of contact receiving chambers 56 also having a generally rectangular configuration when cross sectioned along a plane perpendicular to the upper and lower surfaces 52 and 54. Each chamber 18 has a generally square cross section when viewed from either the upper or lower surface. From the upper surface 52, the chamber 56 extends downwardly to a shoulder 58 located near the lower surface 54. The chamber is also provided with four area reducing members 60 in each corner which engage the contacts 10 as they are inserted into the chamber 56 from the upper surface 52. As each contact 10 is inserted into the chamber 56, the retention leaf spring 34 is deflected inwardly by an inner side of the chamber 56. As the open end 26 of the box-like end section 12 contacts the shoulder 58, the leaf spring 34 is aligned with an opening 62 located within one side wall of the housing 50 between the surfaces 52 and 54. The leaf spring is then urged by its own resiliency into the opening 62 for locking the contact 10 into the housing 50. The housing 50 is further provided with a restricted opening 64 in the lower surface 54 for guiding a square wrap post or round pin, not shown, into the housing chamber 56 and the contact 10 retained therein.

If desired, the contact 10 and its connected wire, not shown, may be removed from the housing 50 by the insertion of an appropriate contact removal tool into the opening 62 for deflecting the leaf spring 34 from the opening 62, thus freeing the contact for removal. An example of a suitable contact removal tool is shown in copending patent application Ser. No. 432,748, filed Jan. 11, 1974, and assigned to the same assignee as the present invention now U.S. Pat. No. 3,852,864.

The contacts shown in FIGS. 1 and 2 provide a stop which prevents the housing 50 in which they may be mounted from being inserted onto a series of square wrap posts or round pins more than the distance established by the right-hand edge of the stop walls 38, FIG. 1, or the extending stop tabs 48, FIG. 2. The stops also provide a stop for a stripped insulated wire which is inserted into the open barrel section 14. When the end of the wire, not shown, abuts the left-hand edge of the stop walls 38 or extending stop tabs 48, the wire is stopped and partially retained until an appropriate crimping tool deforms the wire crimping beams 42 and insulation crimping beams 46 about the wire. The deformation of the beams 42 and 46 is prevented from closing the central box section 16 and the box-like end section 12 by the presence of the stop walls 38 or stop tabs 48.

When the connector housing 50 is to be mounted at the $Z_3$ level upon a series of square posts or round pins, the contact stop walls 38 of FIG. 1 are used. If the $Z_2$ level is desired, the contact stop walls 38 may be foreshortened by removing some of each wall 38 from its right-hand side edge. When the connector is to mount at the $Z_1$ level, the contact stop tabs 48 of FIG. 2 are used.

It will be understood that the preferred embodiment of the contact shown in the drawings may be modified to provide other variations. For example, the length of the contact stop walls 38 has been described as variable to adjust the position at which the housing 50 rests upon suitable posts or pins. Also, one wall or tab may be used in place of two. After consideration of the foregoing specification and referenced drawings, further modifications and variations of the present invention will become apparent to those skilled in the art.

We claim:

1. An electrical contact for joining an electrically conductive square post to an electrically conductive insulated wire, comprising:

a box-like end section at one end of said contact for receiving a first conductive square post formed into a box by four side walls of a continuous metal sheet having one side wall formed from two foreshortened ends of said sheet abutting one another to form a slot extending longitudinally along the axis of said contact;

an open barrel crimp section at the other end of said contact for receiving a second electrically conductive insulated wire;

a central box section formed from the extension of said four side walls of said box-like section with said open barrel crimp section joined to said central box section by the extension of the side wall opposite from said side wall in which said slot is formed wherein the termination of said side wall in which said slot is formed forms the bottom of said central box section; and stop means formed by the continuations of said foreshortened abutting ends of said side walls in which said slot is formed, said abutting continuations extending inwardly into the center of said central box section with abutting surfaces having inner and outer edges wherein the selected location of said innermost edges of said abutting continuations of said foreshortened abutting ends provides a stop surface for said electrically conductive square post at one of a plurality of selected levels and the location of said outermost edges of said abutting continuations of said foreshortened abutting ends provides a stop surface for said electrically conductive insulated wire, said abutting continuations of said foreshortened abutting ends further supporting said central box section and said box-like end section as said open barrel crimp section is crimped upon said second electrically conductive insulated wire.

2. An electrical contact for joining two electrically conductive elements, comprising:

a box-like end section at one end of said contact for receiving a first conductive element formed into a box by four side walls of a continuous metal sheet with one side wall formed from two foreshortened ends of said sheet abutting one another to form a slot extending longitudinally along the axis of said contact;

an open barrel crimp section at the other end of said contact for receiving a second insulated conductive element formed with first means for crimping said insulation and second means for crimping said conductive element;

a central box section formed from the extension of said four side walls of said box-like end section with said open barrel crimp section joined to said central box section by the extension of the side wall opposite from said side wall in which said slot is formed and the ending of the remaining three side walls forming the bottom of said central box section;

first conductive element wiping means extending inwardly from two opposing side walls of said box-like end section adjacent said side wall in which said slot is formed;

latch means extending from said side wall opposite said side wall in which said slot is formed in said central box section having a first end integral with said opposite side wall and a free end extended outwardly therefrom;

stop means having first and second stop means surfaces formed by the continuation of said foreshortened abutting ends of said side wall which extend inwardly into the center of said central box section wherein said first stop means surface is formed by the selected location of the innermost edge of said continuation of said foreshortened abutting ends for providing stop means for said first conductive element at one of a plurality of selected levels within said central box section and said second stop means surface is formed by the outermost edge of said continuation of said foreshortened abutting ends for providing a stop for said second insulated conductive element at the jointure of said central box section and said open barrel crimp section; and said continuation of said foreshortened abutting ends which forms said stop means having contiguous surfaces extending into said center of said central box section for supporting said central box section and said box-like end section as said open barrel crimp section is crimped upon said second insulated conductive element.

3. An electrical contact for joining two electrically conductive elements, comprising:

a box-like end section for receiving a first conductive element formed from a metal sheet with four side walls, one wall having a longitudinal slot formed by abutting foreshortened ends;

an open barrel crimp section for receiving a second conductive element;

a central box section formed by the extension of said four walls of said box-like end section for joining said box-like section and said open barrel crimp section;

support means formed by the continuations of said foreshortened abutting ends extended into said central box section having contiguous facing surfaces for strengthening said contact; and stop means formed by inner and outer edges of said contiguous surfaces of said support means wherein said inner edges provide a stop for said first conductive element and said outer edges provide a stop for said second conductive element.

* * * * *